US008225459B2

(12) United States Patent
Waltemate et al.

(10) Patent No.: US 8,225,459 B2
(45) Date of Patent: Jul. 24, 2012

(54) MULTI-LINK HINGE

(75) Inventors: Dieter-Hermann Waltemate, Hullhorst (DE); Helmut Hunger, Gutersloh (DE)

(73) Assignee: Hettich-Oni GmbH & Co. KG, Vlotho (DE)

( * ) Notice: Subject to any disclaimer, the term of this patent is extended or adjusted under 35 U.S.C. 154(b) by 295 days.

(21) Appl. No.: 12/593,523

(22) PCT Filed: Mar. 14, 2008

(86) PCT No.: PCT/EP2008/053093

§ 371 (c)(1),
(2), (4) Date: Oct. 9, 2009

(87) PCT Pub. No.: WO2008/119647

PCT Pub. Date: Oct. 9, 2008

(65) Prior Publication Data

US 2010/0101052 A1 Apr. 29, 2010

(30) Foreign Application Priority Data

Mar. 29, 2007 (DE) ..... 20 2007 004 621 U

(51) Int. Cl.
*E05D 3/06* (2006.01)

(52) U.S. Cl. ..... 16/366; 16/286; 16/371

(58) Field of Classification Search ..... 312/322, 312/323, 325, 319.2, 319.6, 319.7; 16/366, 16/367, 370, 371, 280, 281, 282, 286, 287, 16/288; 292/70, 73, 75, 76, 77, 79, 262, 292/267; 49/254, 260, 255, 246, 371
See application file for complete search history.

(56) References Cited

U.S. PATENT DOCUMENTS

| | | | | |
|---|---|---|---|---|
| 4,083,082 | A * | 4/1978 | Holmes | 16/288 |
| 5,058,238 | A * | 10/1991 | Lautenschlager | 16/278 |
| 5,437,079 | A * | 8/1995 | Park | 16/54 |
| 6,374,459 | B1 * | 4/2002 | Zetti | 16/366 |
| 6,684,453 | B2 * | 2/2004 | Wang | 16/54 |

(Continued)

FOREIGN PATENT DOCUMENTS

DE 20 2005 016 375 U1 1/2006

(Continued)

OTHER PUBLICATIONS

International Search Report, for International Patent Application PCT/EP2008/053093, filed Mar. 14, 2008.

(Continued)

*Primary Examiner* — Chuck Y. Mah
(74) *Attorney, Agent, or Firm* — Barnes & Thornburg LLP

(57) ABSTRACT

A multi-link hinge for a door includes a fastening element that is securable to a furniture body. A pivotable door bearing is movable with respect to the fastening element. The pivotable door bearing defines an opened position, a closed position, and a pivot range between the opened position and the closed position. Several levers are connected to one another in a scissored arrangement. The levers connect the fastening element to the pivotable door bearing. A spring is operably disposed between the fastening element and the pivotable door bearing. The spring is pre-tensioned to bias the pivotable door bearing into the closed position. A linear damper is operably disposed between the fastening element and the pivotable door bearing. The linear damper dampens a closing movement of the door bearing. The multi-link hinge may be employed to prevent slamming of refrigerator doors, for example.

8 Claims, 15 Drawing Sheets

U.S. PATENT DOCUMENTS

| | | | | |
|---|---|---|---|---|
| 7,406,749 | B2 * | 8/2008 | Herper | 16/368 |
| 7,500,287 | B2 * | 3/2009 | Brustle | 16/286 |
| 7,543,356 | B2 * | 6/2009 | Zetti | 16/288 |
| 7,562,416 | B2 * | 7/2009 | Lautenschlager et al. | 16/286 |
| 2005/0015927 | A1 * | 1/2005 | Kropf | 16/286 |
| 2005/0071953 | A1 * | 4/2005 | Salice | 16/285 |
| 2005/0155180 | A1 | 7/2005 | Lin | |
| 2007/0251058 | A1 | 11/2007 | Fitz et al. | |
| 2008/0189906 | A1 | 8/2008 | Resnik et al. | |
| 2008/0276422 | A1 | 11/2008 | Beckmann et al. | |

FOREIGN PATENT DOCUMENTS

| | | | |
|---|---|---|---|
| DE | 10 2005 004 957 | A1 | 8/2006 |
| DE | 20 2006 003 196 | U1 | 8/2007 |
| DE | 20 2006 013 358 | U1 | 2/2008 |
| EP | 1 538 293 | A1 | 6/2005 |
| EP | 1 555 372 | A1 | 7/2005 |
| WO | 2006/053364 | A1 | 3/2006 |
| WO | 2006/114255 | A1 | 11/2006 |

OTHER PUBLICATIONS

Written Opinion (in German) for International Patent Application No. PCT/EP2008/053093.

* cited by examiner

Fig. 8A
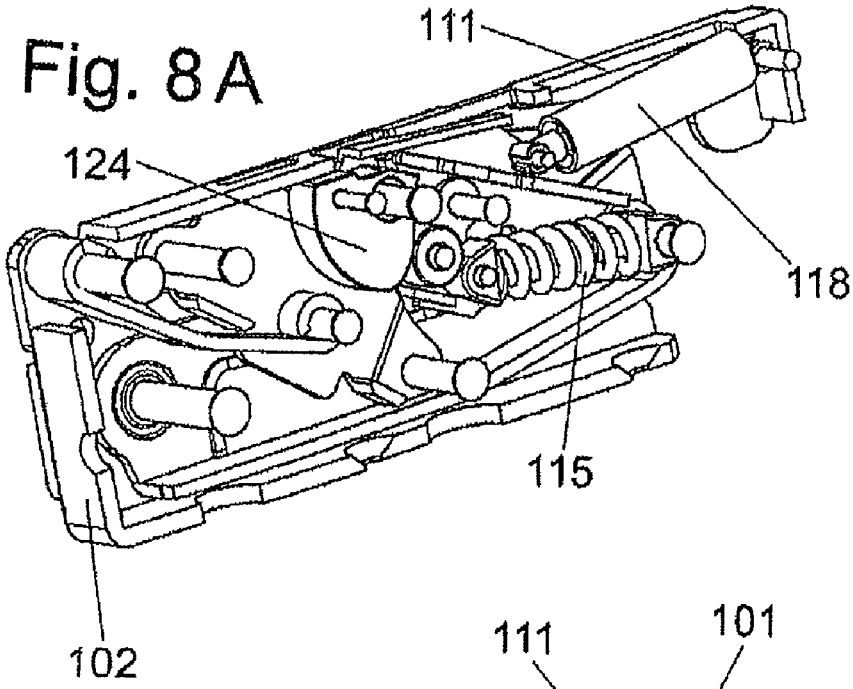
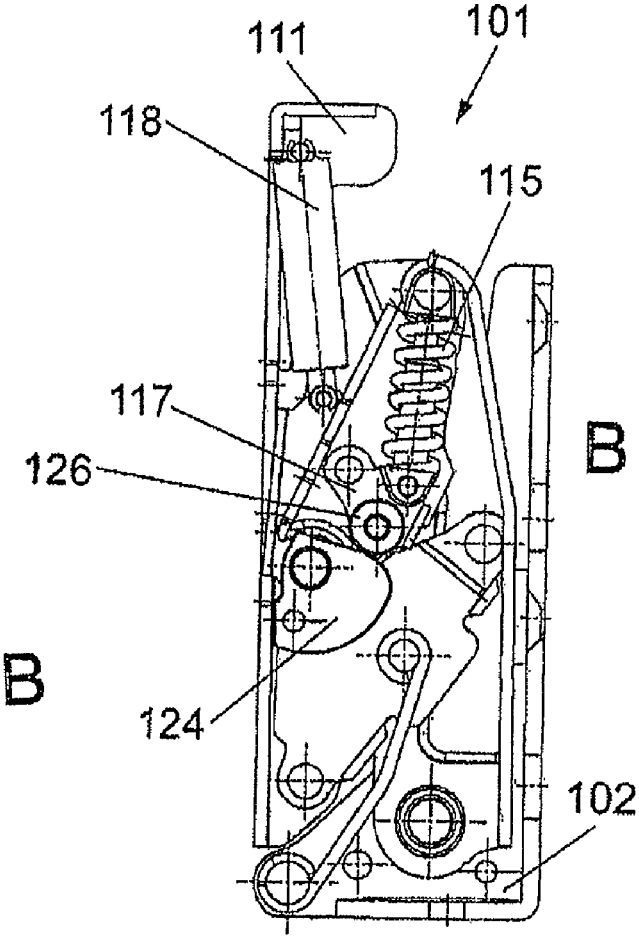
Fig. 8B

Fig. 11 A
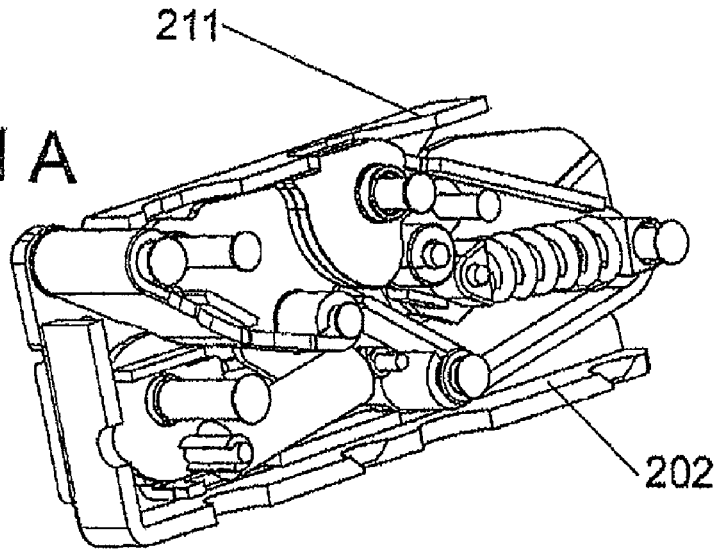
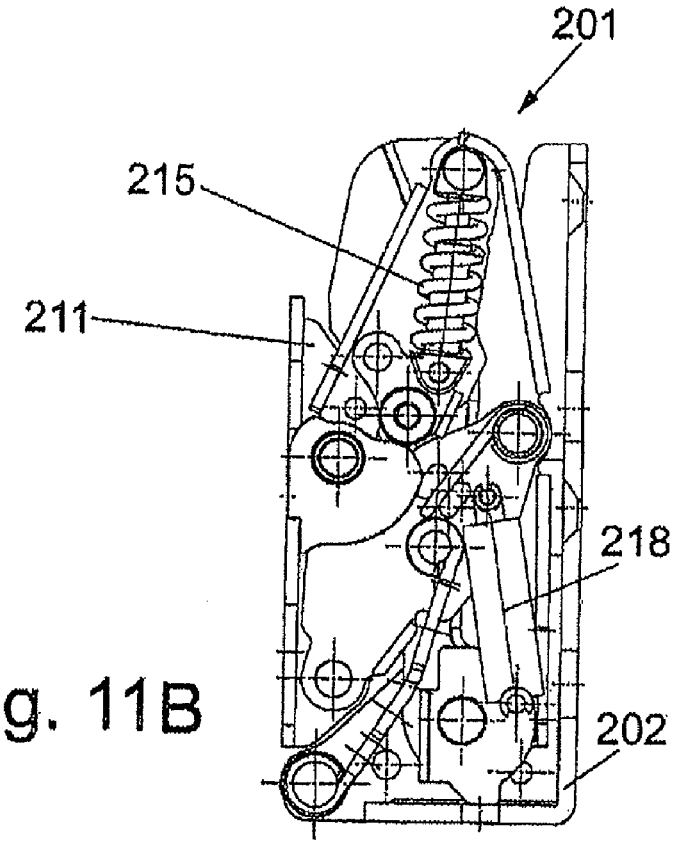
Fig. 11B

MULTI-LINK HINGE

CROSS-REFERENCE TO RELATED APPLICATION(S)

This is a United States National-Stage Non-Provisional Patent Application that relies for priority on PCT Patent Application No. PCT/EP2008/053093, filed on Mar. 14, 2008, and on German Patent Application No. DE 20 2007 004 621.9, filed on Mar. 29, 2007, the contents of both of which are incorporated herein by reference.

FIELD OF THE INVENTION

The present invention relates to a multi-link hinge, in particular for refrigerator doors, with a fastening element which can be secured to a furniture body and is connected to a pivotable door bearing via a plurality of levers connected to one another in a scissor-like fashion, the door bearing being pre-tensioned into a closed position via a spring.

DESCRIPTION OF THE RELATED ART

German Patent Application No. DE 10 2005 004 957 discloses a multi-link hinge in which a first fastening part is fastened to a furniture body and a second fastening part is fastened to a door. These two fastening parts are joined together via a plurality of levers, wherein relatively thick doors, such as in refrigerators, can be opened via the scissor-like articulation of the levers. A spring is provided to pre-tension the multi-link hinge into a closed position. A drawback of this multi-link hinge is the fact that a door arranged on the fastening part can slam in an uncontrolled manner: this is further supported by the spring.

SUMMARY OF THE INVENTION

It is therefore the object of the present invention to provide a multi-link hinge which, in a simple construction, prevents slamming of a door mounted on the multi-link hinge.

This object is achieved by a multi-link hinge with a construction and operation as set forth in greater detail below.

According to the invention, a linear damper is provided that dampens a closing movement of the door bearing, so that a door attached to the multi-link hinge cannot slam in an uncontrolled manner. The reason for this is that the closing movement is dampened by the damper, which reduces the closing speed of the door.

According to a preferred embodiment of the invention, the damper is effective only over a portion of the pivot range of the door bearing. The reason for this is that dampening is required, in particular, shortly before the closed position. However, during an opening movement, the damper may introduce a certain sluggishness that may be considered troublesome by the user. Dampening, therefore, is maximized during only part of the pivot range, in keeping with the user's wishes. In this embodiment, the door bearing can be pivotable relative to the fastening element through more than 100°, the damper being effective in a closing range between 20° and 40°, preferably about 25° to 35°.

In order for the consumer to feel that the closing movement runs smoothly, the spring can pre-tension the door bearing into the closed position. The spring also may support the closing movement through a pivot range which is larger than the pivot range in which the damper is effective. Preferably, the force of the spring for closing the door bearing commences about 5° to 20°, preferably 10° to 15°, before the damper.

For a compact construction, the damper is preferably arranged within the multi-link hinge, both in the closed position and in an opened position. Equally, the spring is preferably arranged within the multi-link hinge, providing, in addition to a compact construction, protection from external influences. The arrangement within the multi-link hinge refers to, in particular, an arrangement between the fastening element and the door bearing.

According to a further embodiment of the invention, four levers, which have seven rotational shafts, are provided for articulating the door bearing to the fastening element. In this embodiment, a first and a second lever can be rotatably mounted on the fastening element, while a third and a fourth lever are rotatably mounted on the door bearing. The levers are then coupled to one another via three rotational shafts.

According to a further embodiment of the invention, one side of the spring is held on a spring bearing and, at the opposing side, a spring carriage is provided that is mounted on a roller. As a result of the geometric configuration of the spring carriage and the roller, the spring force generated by the spring can be adjusted as a function of the position of the fastening element relative to the door bearing. In particular, it is possible to employ simple mechanical means to define the range in which the spring is effective.

Preferably, the damper comprises a housing and a piston rod which is displaceable relative to the housing. At one side, the damper is mounted in a slot. The reason for this is that the dampening effect of the damper should be effective only in a range shortly before the closed position. In an opened position (or during opening), the damper should be free running. This can easily be achieved by mounting the damper at one side in a slot, where the end of the slot introduces (or initiates) the dampening process.

Various geometric embodiments or variants of the curve course of the control disk influence, for example, the forces to be applied by the user for opening and closing the door. The change of the curve geometry also allows the self-tightening angle of the door to be altered, as the change of the curve geometry also provides a change of the direction of the applied forces.

Raising the curve in the open position can also provide cushioning of the door during the opening movement.

Lowering in the curve geometry can allow a locking position of the door to be reached, preferably in the opened position. The user must apply a force in order to move the door out of this opened position. The curve course relates to the control curve and, if appropriate, also to the spring carriage.

According to a further embodiment of the invention, the spring is movable at one end via a curve guide. In this embodiment, the curve guide can in this case have a control curve which is coupled to the door bearing and against which rests a roll which is pre-tensioned by the spring. In this embodiment, the geometry of the control curve defines the spring force and the beginning of the spring effect during a closing movement of the door bearing.

Preferably, the damper is, at one side, rotatably mounted and, at the opposing side, held on a pivotable driver which can be moved, during closing, up to a stop. Thus, in an opening range, the driver can allow free running of the damper, the damper having its effect once the driver abuts the stop.

For a construction which is as compact as possible, the damper can also be arranged between two levers, wherein free running in an opening position can also be attained by way of a corresponding mechanism within the damper.

According to a further embodiment of the invention, the damper is fixed at one side to a rotatable driver disk, the rotation range of which is limited by a stop. This allows the dampening range to be defined using mechanically simple means.

Other aspects of the present invention will be made apparent from the discussion that follows.

BRIEF DESCRIPTION OF THE DRAWINGS

The invention will be described hereinafter in greater detail based on four exemplary embodiments and with reference to the drawings, in which:

FIGS. 5A to 8B are a plurality of views of a second exemplary embodiment of a multi-link hinge according to the invention, shown in different positions;

FIGS. 9A to 11B are a plurality of views of a third exemplary embodiment of a multi-link hinge according to the invention, shown in different positions.

DETAILED DESCRIPTION OF EMBODIMENT(S) OF THE INVENTION

Figure 1A:
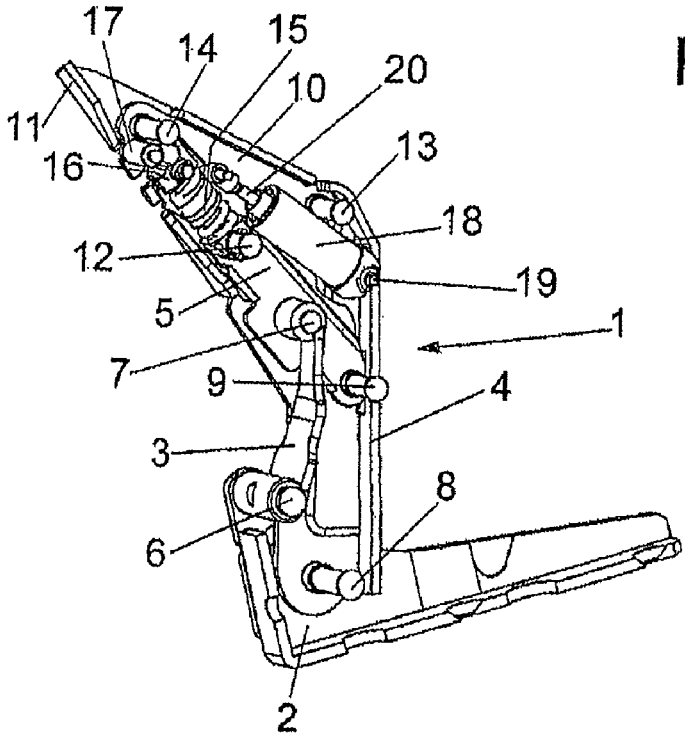
FIGS. 1A-4B are a plurality of views of a first exemplary embodiment of a multi-link hinge according to the invention, shown in different positions.

While the present invention is described in connected with several embodiments, those skilled in the art should appreciate that the invention is not limited solely thereto. To the contrary, those skilled in the art should appreciate certain variations and equivalents based on the discussion of the described embodiments. Those variations and equivalents are intended to be encompassed by the present invention.

A multi-link hinge 1 includes a fastening element 2 which can be secured to a body and on which a first lever 3 and a second lever 4 are rotatably arranged. The first lever 3 and the second lever 4 are, in turn, connected to a third lever 5. Furthermore, the second lever 4 is connected to a fourth lever 10, a door bearing 11 being pivotably mounted on the third and fourth levers 5 and 10. The first lever 3 is, in this embodiment, mounted on the fastening element 2 about a shaft 6. The first lever 3 also is mounted on the lever 5, about a rotational shaft 7. The fastening lever 2 is rotatably connected to the second lever 4 via a shaft 8. The second lever 4 also is connected to the third lever 5 via a shaft 9. In addition, a shaft 13, to which the fourth lever 10 is articulated, is provided on the second lever 4. Thus, four levers 3, 4, 5 and 10 are provided, which pivotably connect the door bearing 11 to the fastening element 2 via seven shafts 6, 7, 8, 9, 12, 13 and 14. Despite a certain distance between the door bearing 11 and the fastening element 2, it is possible to provide, via this lever mechanism, a pivoting movement which is advantageous, specifically for refrigerator doors or other heavy door elements.

Figure 1B:
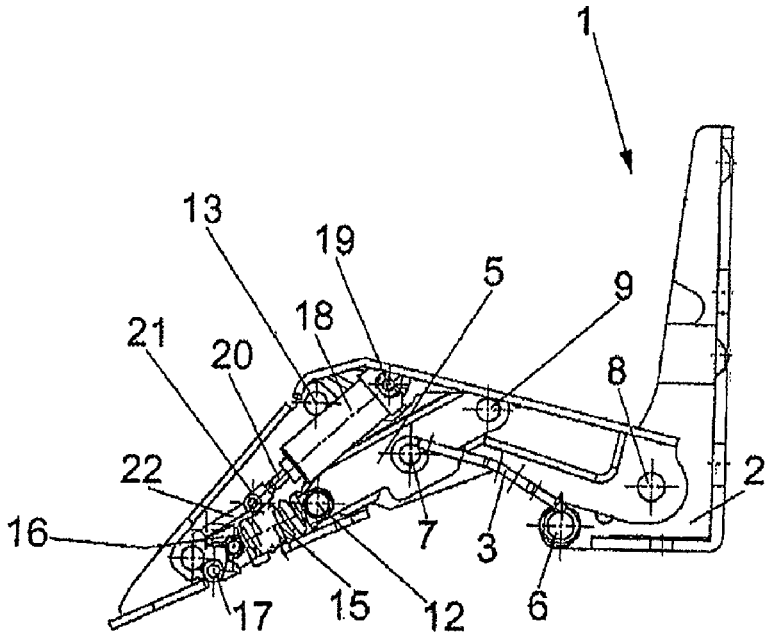

FIGS. 1A to 1B show the multi-link hinge at an opened angle of 115°. A spring 15 is in the tensioned state and is tensioned between the shaft 12 and a spring carriage 16. The spring carriage 16 is arranged adjacent to a roller 17. The roller 17 that actuates the spring carriage 16 is mounted in the fourth lever 10.

Also provided is a damper 18, which is mounted with a housing on the second lever 4 about a shaft 19. The damper 18 includes a retractable and extendable piston rod 20 which, at one end 21, is guided in a slot 22 on the fourth lever 10. In the wide opened position, the end 21 can slide freely in the slot 22 and the damper 18 has no effect (i.e., the damper 18 does not provide any dampening effect).

Figure 2A:
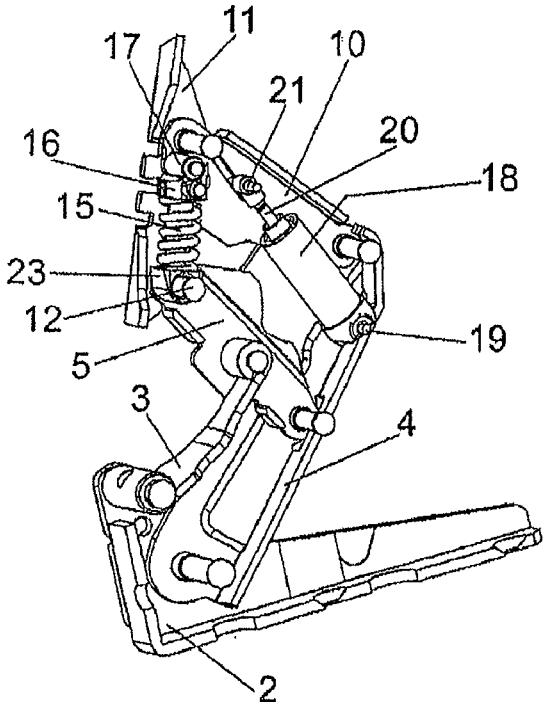
Figure 2B:
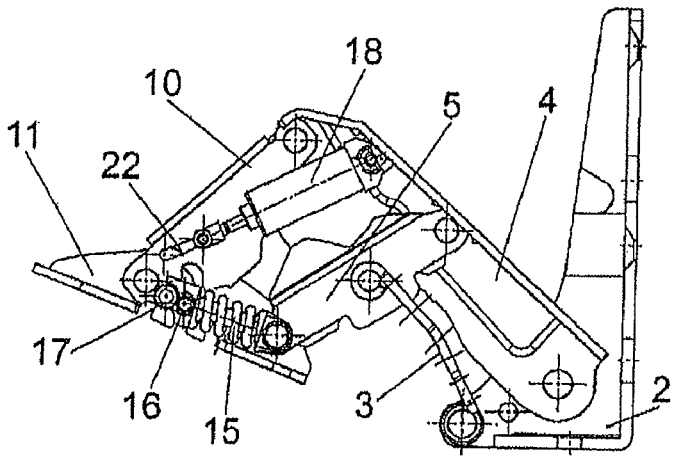

If the multi-link hinge 1 is moved into the position shown in FIGS. 2A and 2B having an opened angle of about 69°, then the spring 15 is in the tensioned state. In this position, the roller 17 has entered a receptacle on the spring carriage 16 and, in the event of a further closing movement, tension in the spring 15 is gradually relieved, thus supporting the closing movement of the door bearing 11.

The damper 18 is, at the end 21, still held so as to be able to move freely in the slot 22 and, therefore, does not provide any dampening effect.

Figure 3A:
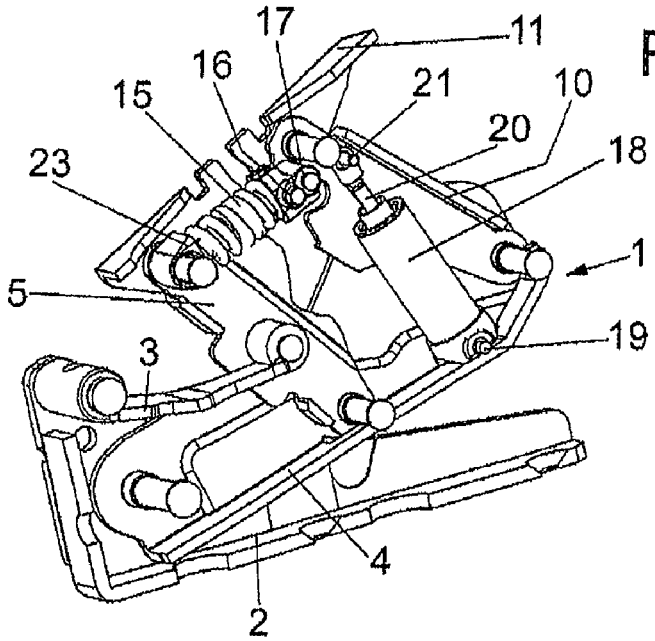
Figure 3B:
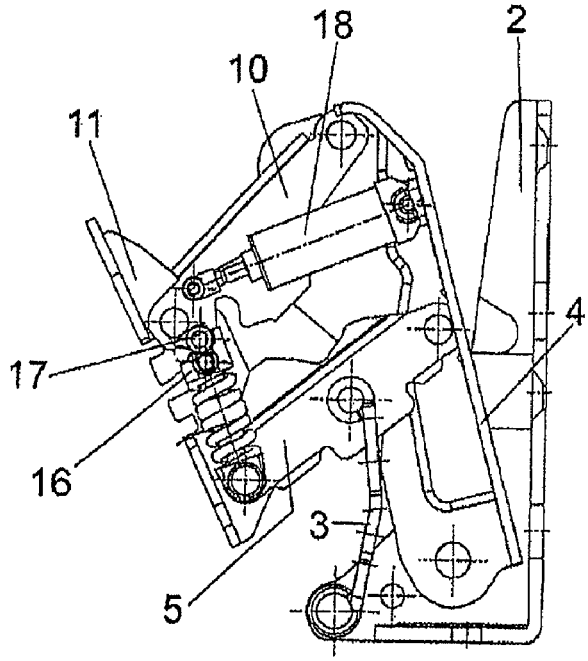

As the door bearing 11 is closed further, the position shown in FIGS. 3A and 3B, having an opened angle of about 26°, is reached. During the closing movement, further tension in the spring 15 is relieved via the spring carriage 16 and the roller 17, thus producing between the door bearing 11 and fastening element 2 a torque which causes automatic closing. Here, the end 21 of the damper 18 has arrived at the end of the slot 22, so that the effect of the damper 18 commences from this angular position. In this example, the damper 18 is embodied as a linear damper, which generates a much higher dampening force during retraction than during extension. The dampening effect can differ by a factor of 5 to 15 times between retraction and extension.

Figure 4A:
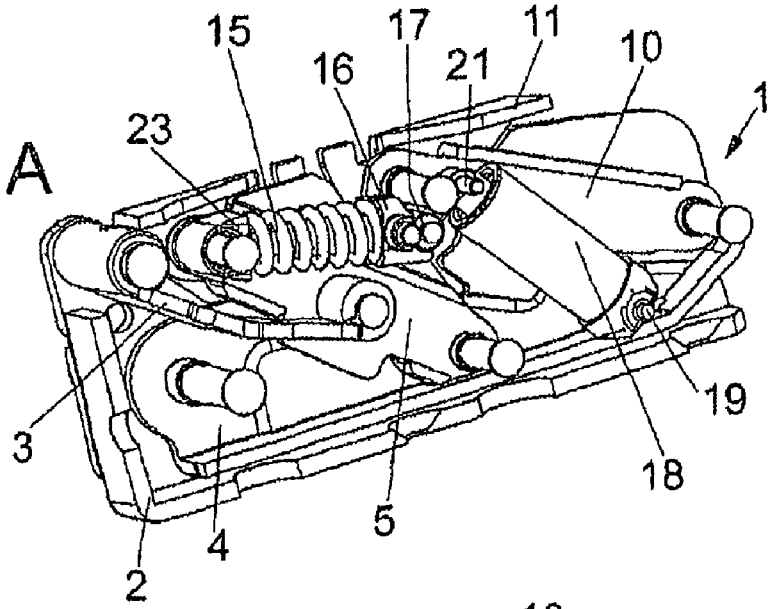
Figure 4B:
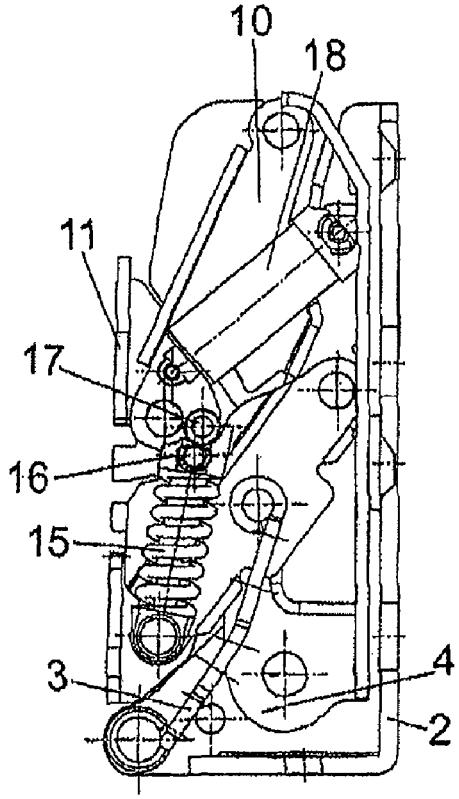

FIGS. 4A and 4B show the closed position of the multi-link hinge 1. The spring 15 is now only in a slightly pre-tensioned state, as a result of which a low torque is still generated in order to tension the door bearing 11 into the closed position. The closing movement of the door bearing 11 has moved the damper 18 into a retracted position where the piston rod 20 is received in the housing of the damper 18. In the closed position, the multi-link hinge 1 is embodied in a substantially box-shaped manner, the fastening element 2 and the door bearing 11 being provided at opposing sides of the box.

FIGS. 5A to 8B show a second embodiment of a multi-link hinge 101, in which a fastening element 102 is connected to a door bearing 111 via a first lever 103, a second lever 104, a third lever 105, and a fourth lever 110. The lever mechanism comprises seven rotational shafts 106, 107, 108, 109, 112, 113 and 114 and is embodied in a similar manner to the first exemplary embodiment.

A spring 115 is mounted at one side on a holder 123 via the rotational shaft 113. The spring 115 is mounted between the lever 104 and the lever 110. The spring 115 is held at the opposing side on a bearing 116, which is held on a rocker 117. A roller 126, which rests against a curve guide with a control disk 124, is also mounted on the rotatable rocker 117.

Also provided is a damper 118, the housing of which is held on a bearing 119 on the door bearing 111. The piston rod 120 protruding from the housing is rotatably held at one end 121 on a driver 122.

Figure 5A:
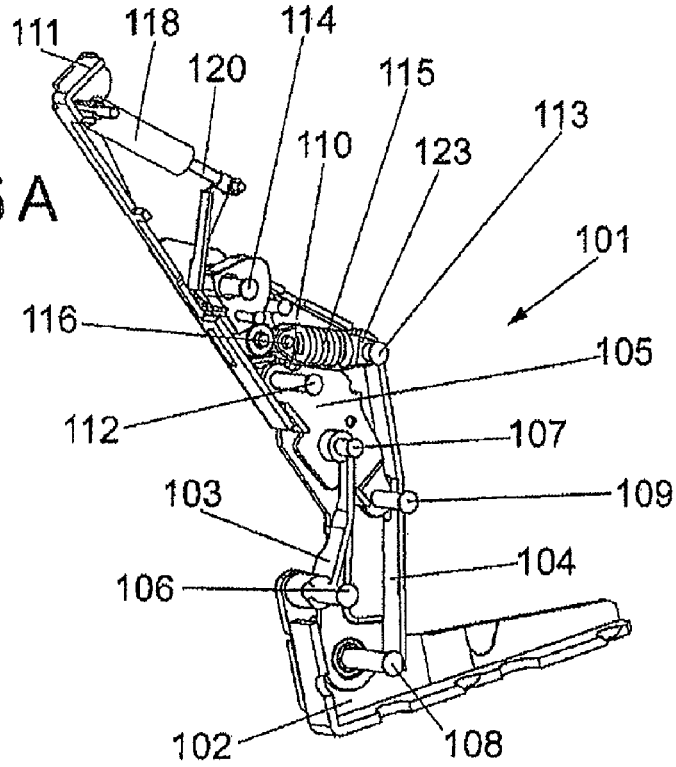
Figure 5B:
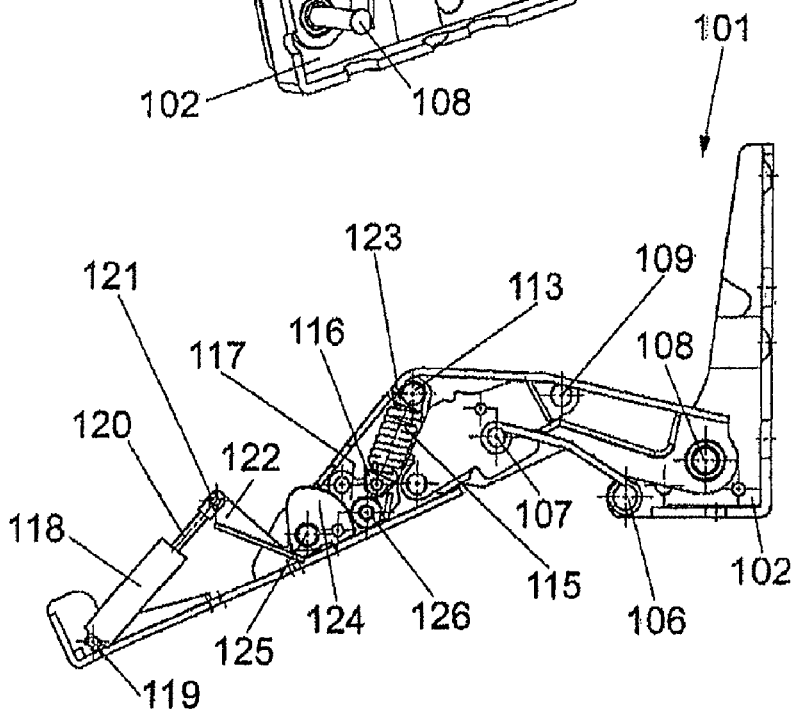

FIGS. 5A and 5B show the multi-link hinge 101 at an opened angle of about 115°, the spring 115 being in the tensioned state. The spring 115 does not yet exert any closing force on the door bearing 111, and the damper 118 is not yet active in a closing movement out of this position.

Figure 6A:
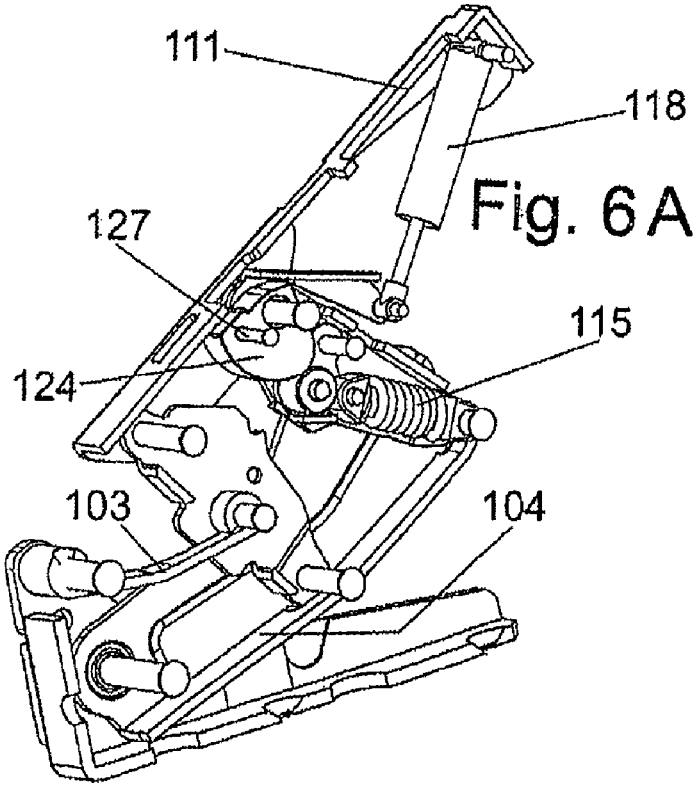
Figure 6B:
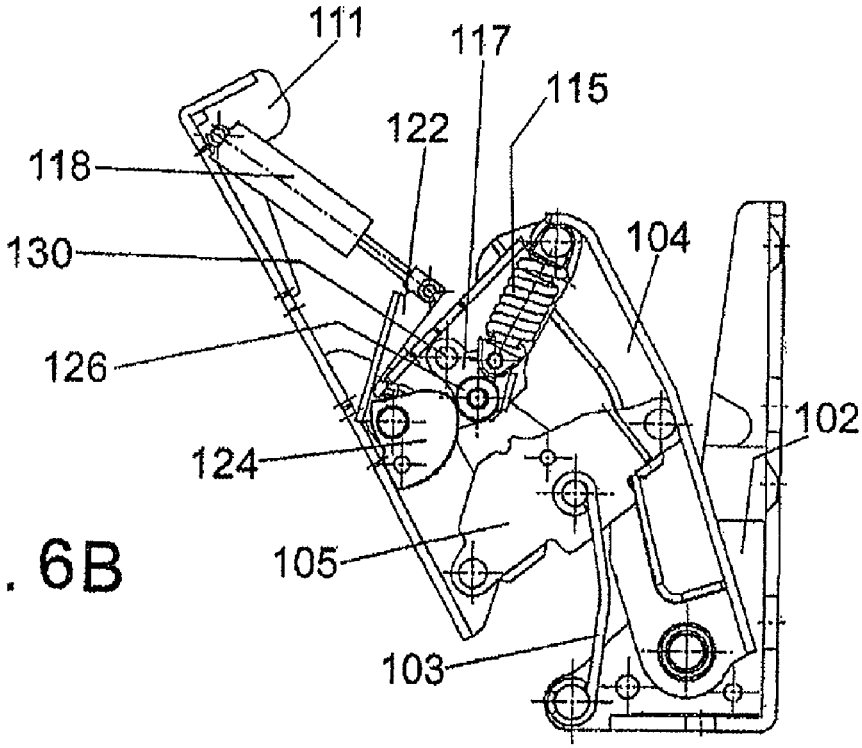

When the door bearing 111 is pivoted further in a closing movement, the position shown in FIGS. 6A and 6B is passed through, in which an opened angle of about 30° is present. In this opened position, the spring 115 begins, as a result of the roller 126 rolling along the control curve 124 and the rocker 117 rotating about the shaft 130, to relax. In this embodiment, the control curve 124 is mounted on the door bearing 111, for example, via a journal 127. It is also possible to make the control curve 124 integral with the door bearing 111. As a result of the release of tension from the spring 115 during the closing movement, a torque is generated for closing the door bearing 111, leading to automatic closing. In this state, the damper 118 remains in a fully extended position and causes no dampening effect.

Figure 7A:
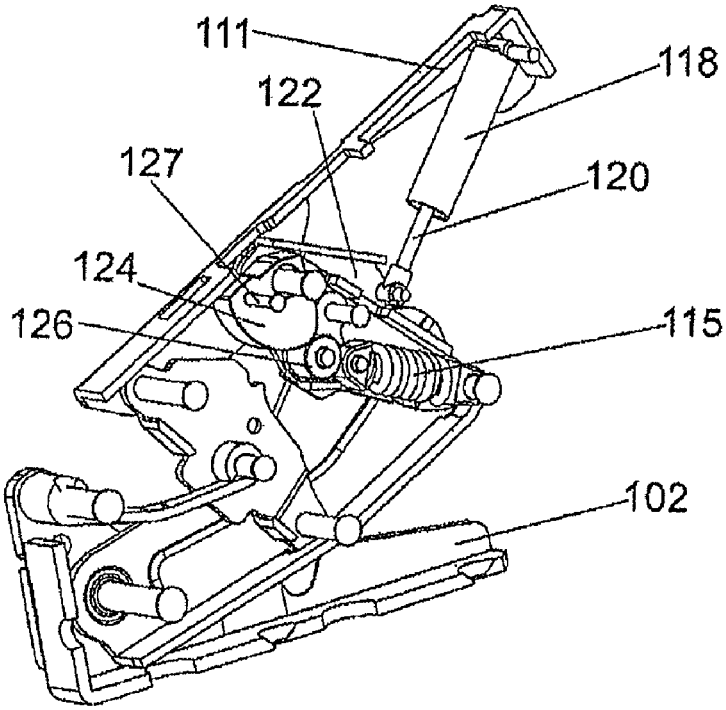
Figure 7B:
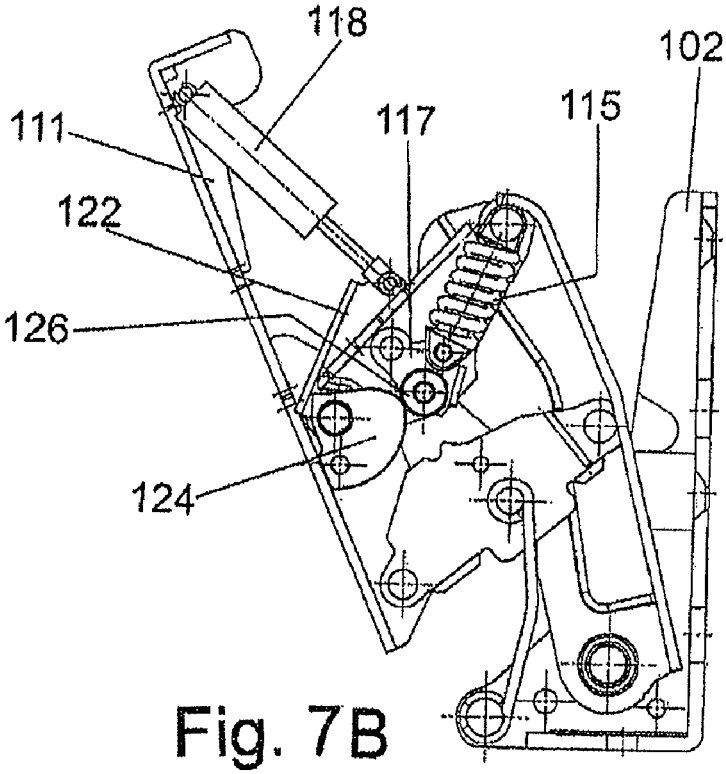

FIGS. 7A and 7B show a position in which the door bearing 111 assumes roughly an opened angle of 24°. In this position, the roller 126 rolls off the control curve 124 and further tension is released from the spring 115. This supports the closing movement of the door bearing 111. Furthermore, the driver 122 strikes the lever 110 and can no longer be pivoted about the shaft 114. As a result, the piston rod 120 begins to enter the housing of the damper 118 and dampening is, thus, attained.

FIGS. 8A and 8B show the closed position of the multi-link hinge 101. The sides for the door bearing 111 and the fastening element 102 are oriented parallel to one another and the damper 118 is in the retracted position. The spring 115 is still slightly tensioned and rolls along the control curve 124 via the roller 126, thus generating a closing force for the door bearing 111.

FIGS. 9A to 11B show a third embodiment of a multi-link hinge 201 which is constructed in a similar manner to the second embodiment, similar components being provided with reference numerals increased by "100". The multi-link hinge 201 comprises a spring 215, which is mounted at one side on the shaft 213 between the lever 204 and the lever 210. At the opposing side, the spring 215 is held on a bearing 216, which is mounted with a roller 226 on a rocker 217 which rests against a control curve 224. The control curve 224 is, in this case, held on the door bearing 211.

Figure 9A:
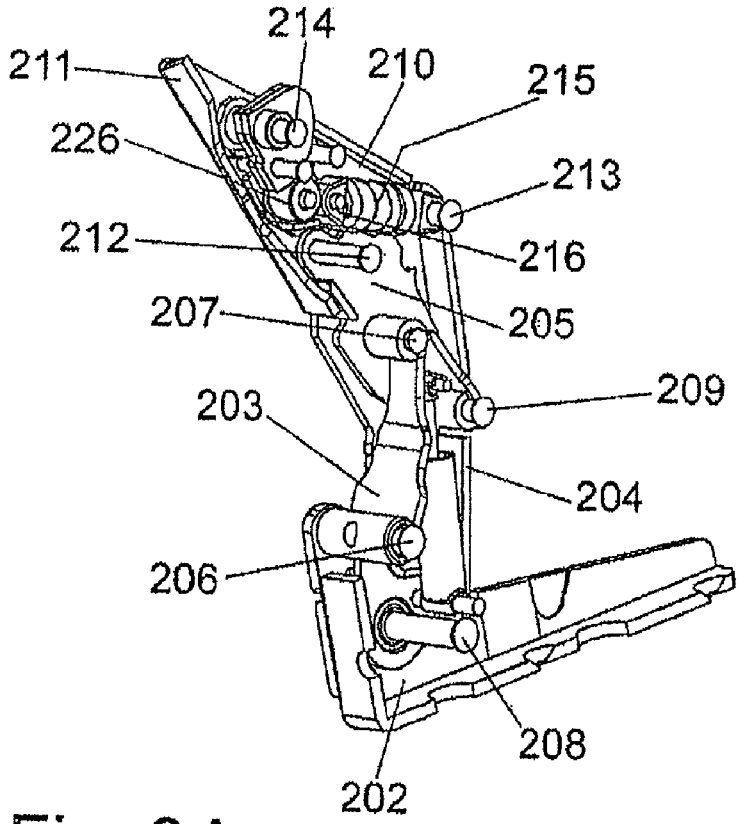
Figure 9B:
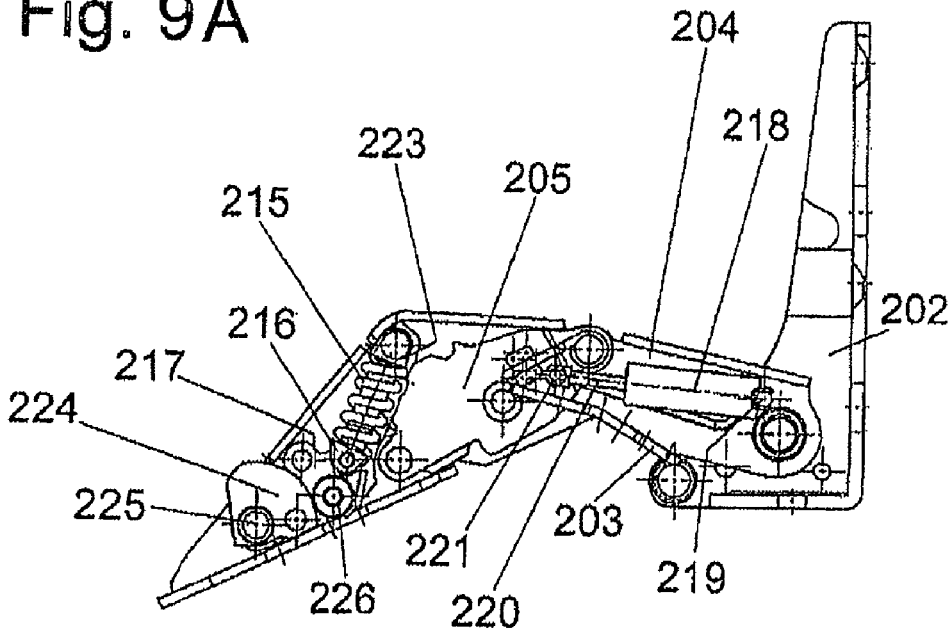

FIGS. 9A and 9B show an opened position of about 115°. The spring 215 is in the tensioned state. The roller 226 runs along the control curve 224 in such a way that the spring tension is initially not altered.

Also provided is a damper 218, the housing of which is mounted on a shaft 219, which is embodied on the lever 204. A piston rod 220 is, at one end 221, rotatably mounted on the lever 205.

Figure 10A:
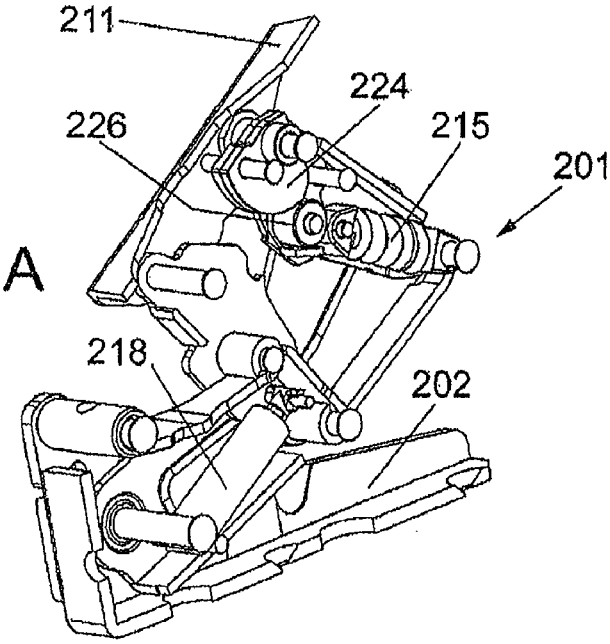
Figure 10B:
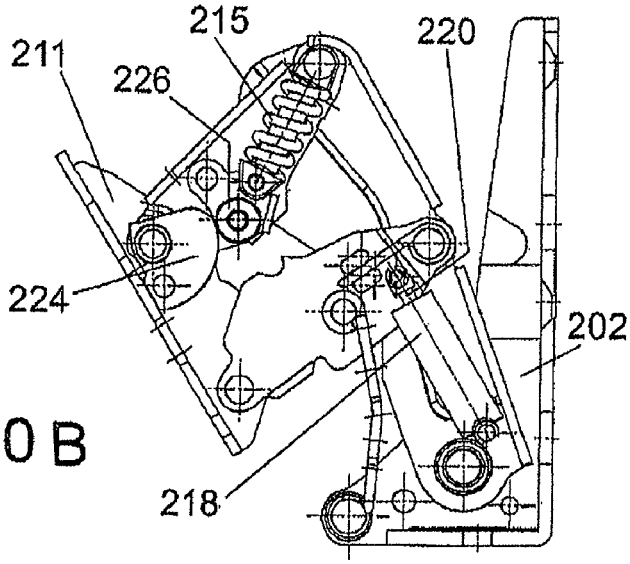

FIGS. 10A and 10B show the multi-link hinge 201 in an opened position of about 32°. In this position, the spring 215 begins to relax as the door bearing 211 closes, as the roller 226 runs along the control curve 224. The damper 218 begins to dampen the closing movement at a slightly smaller opening angle, of, for example from 25° to 30°. Although the piston rod 220 has already entered the housing of the damper 218 to a certain degree, the damper 218 is embodied in such a way that a significant dampening effect occurs only once in this position. The reason for this is that the retraction of the piston rod 220 up to this point can take place in a similarly smooth-running manner as the extracting of the piston rod 220, so that the user can hardly detect a dampening effect.

FIGS. 11A and 11B show the multi-link hinge 201 in the closed position, the construction being, again, substantially box-shaped. All of the levers, bearings, the damper 218 and also the spring 215 are received between the fastening element 202 and the door bearing 211.

FIGS. 12A to 15B show a fourth exemplary embodiment of a multi-link hinge 301. The basic construction of the fastening element 302 and the door bearing 311, with the levers 303, 304, 305, and 310, and with the associated rotational shafts 306, 307, 308, 309, 312, 313 and 314, is embodied in a similar manner to the preceding exemplary embodiments.

The multi-link hinge 301 comprises a spring 315, which, at one end, is mounted on the shaft 313 between the lever 304 and the lever 310 and, which, at the opposing side, is held on a bearing 316 which is secured to a rocker 317. A roller 326, which is also mounted on the rocker 317, runs along a control curve 324, which is held securely on the door bearing 311. Also provided is a damper 318, which is mounted at the side of the housing on a shaft 319 which is arranged on a rotatable driver disk 327. The damper 318 comprises a retractable and extendable piston rod 320 which, at the end 321, is mounted on the lever 305.

Figure 12A:
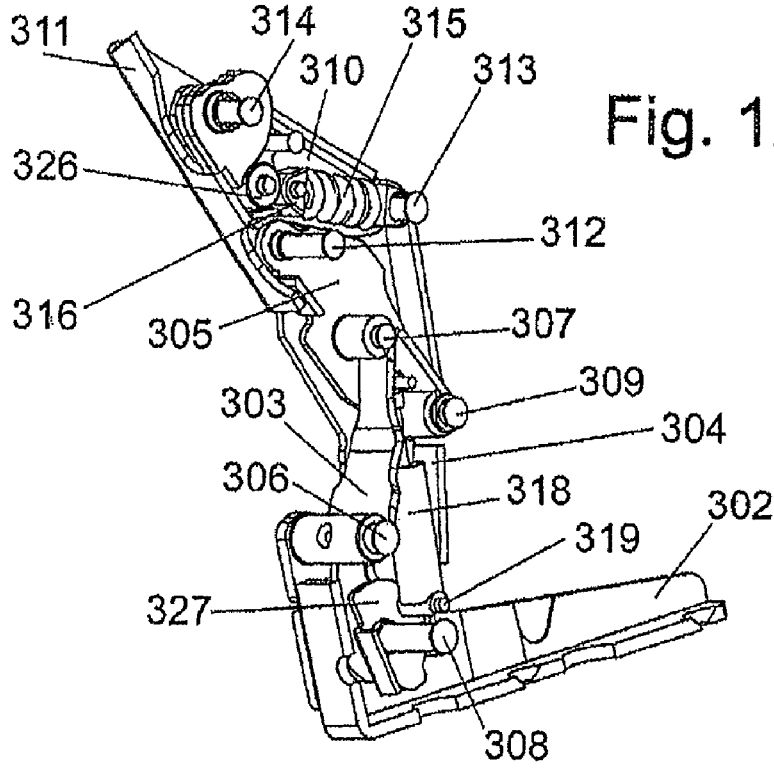
FIGS. 12A to 15B are a plurality of views of a fourth exemplary embodiment of a multi-link hinge according to the invention, shown in different positions.
Figure 12B:
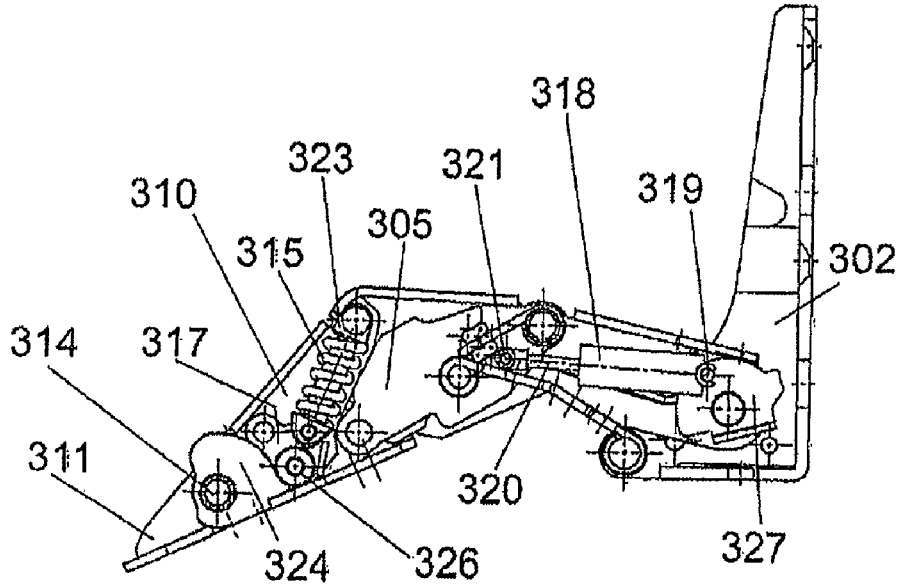

In FIGS. 12A and 12B, the multi-link hinge 301 is in a wide opened position, having an opened angle of about 115°. The spring 315 is in the tensioned state. If the door bearing 311 is closed from this position, the roller 326 rolls along the control curve 324, the position on the rocker 317, on which the bearing 316 is also arranged for receiving an end of the spring 315, initially remaining the same. Therefore, to begin with, the spring 315 does not generate any closing force.

Figure 13A:
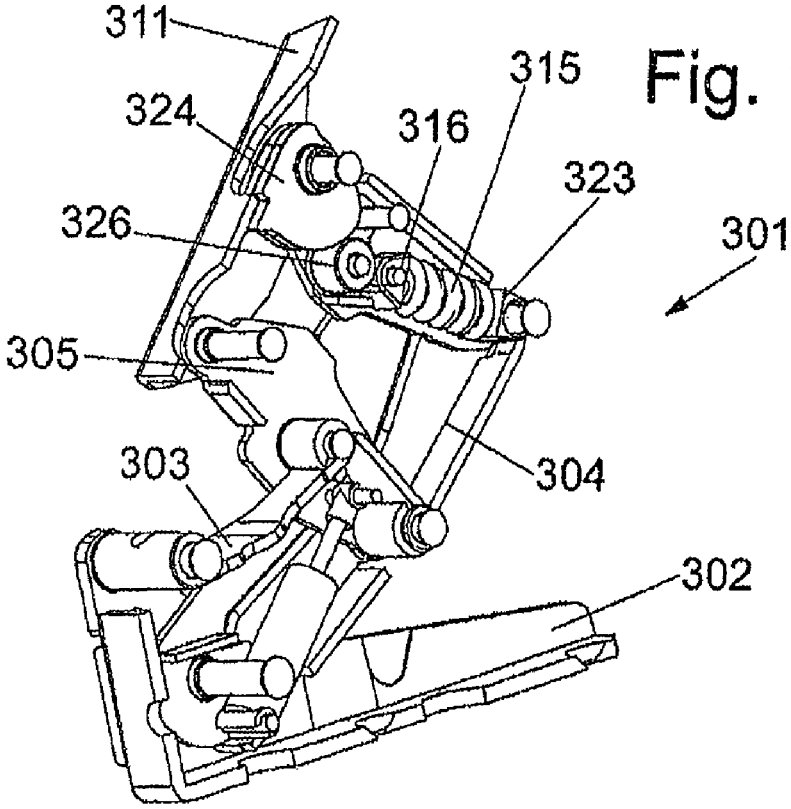
Figure 13B:
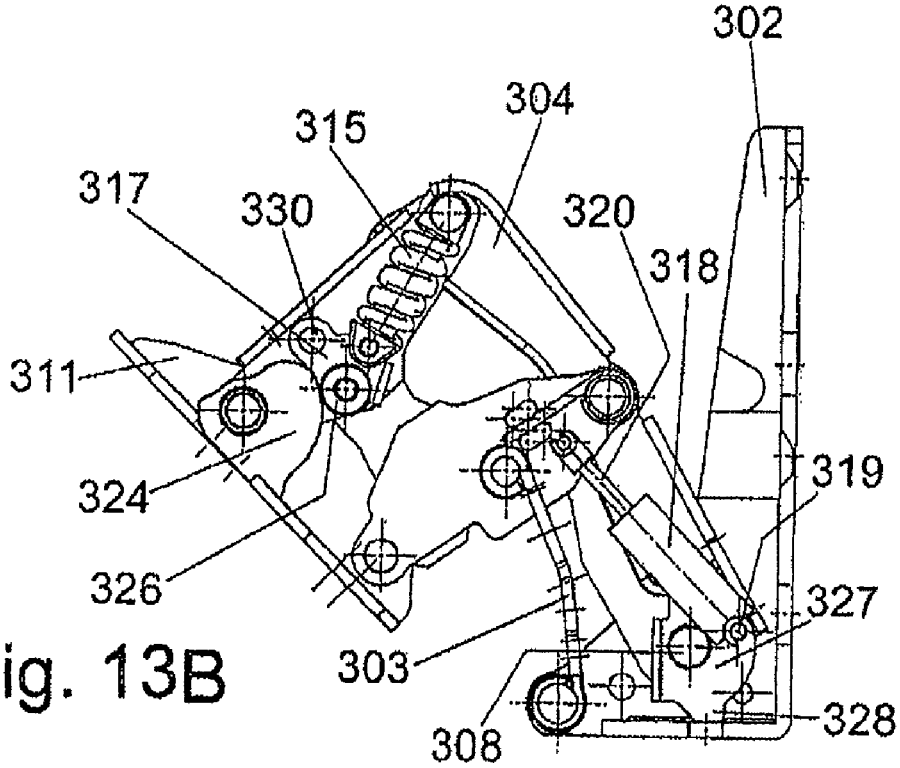

FIGS. 13A and 13B show the multi-link hinge 301 at an opened angle of 45°. The spring 315 is still in the tensioned state. The roller 326, which is mounted on the rocker 317, is running along the control curve 324 and has not yet been pivoted about the shaft 330. As a result, the spring 315 does not yet have any effect for automatic closing.

As a result of the closing of the driver disk 327, the damper 318 has rotated about the shaft 308 between the fastening element 302 and lever 304 to the extent that a stop 328 rests against the fastening element 302 and prevents further rotation of the driver disk 327 about the shaft 308. As a result, the piston rod 320 begins to enter the housing of the damper 318, wherein, to begin with, no dampening effect occurs and the piston rod 320 can be inserted in a smooth-running manner.

Figure 14A:
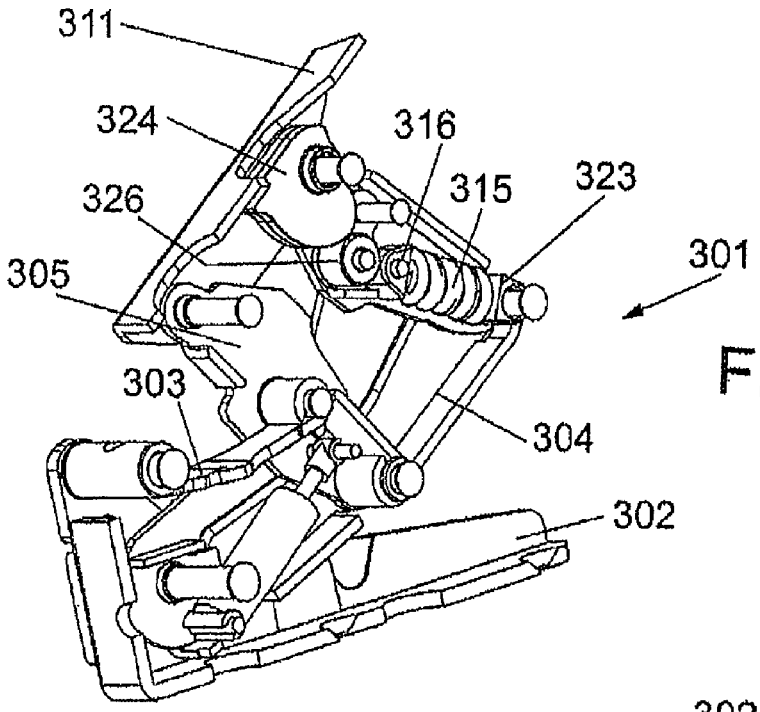
Figure 14B:
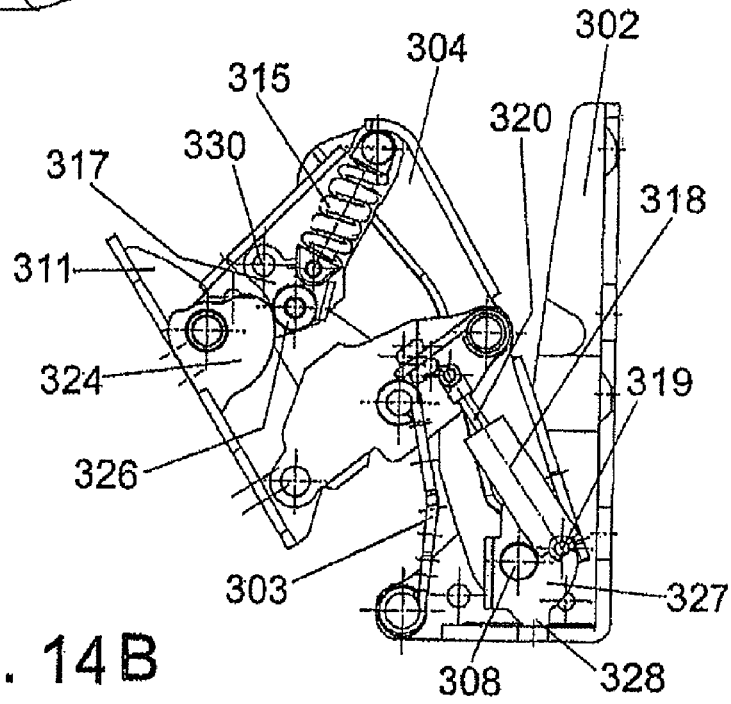

FIGS. 14A and 14B show the multi-link hinge 301 having an opened angle of about 32°. As a result of the roller 326 rolling along the control curve 324, the spring 315 begins to pivot the rocker 317, so that the spring 315 relieves tension. As a result, the spring 315 presses the door bearing 311 into a closing position and ensures automatic closing. From this angular position, the effect of the damper 318 now commences, as the piston rod 320 has entered the housing of the damper 318 to a necessary degree so that dampening may now take place.

Figure 15A:
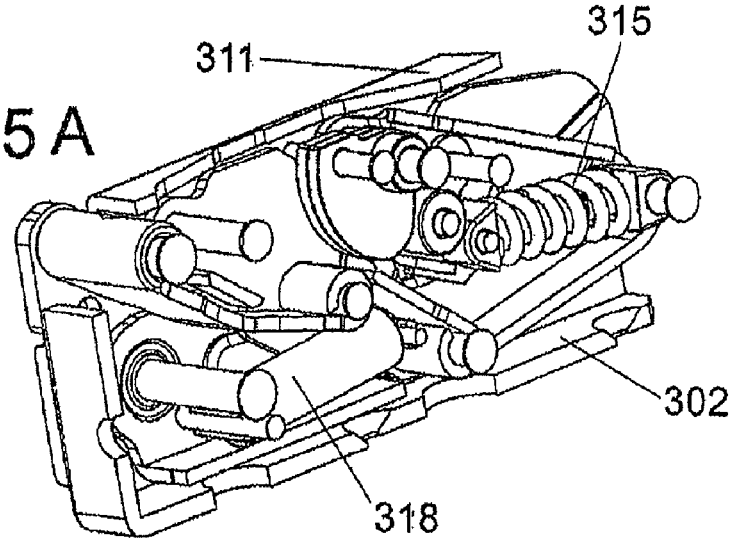
Figure 15B:
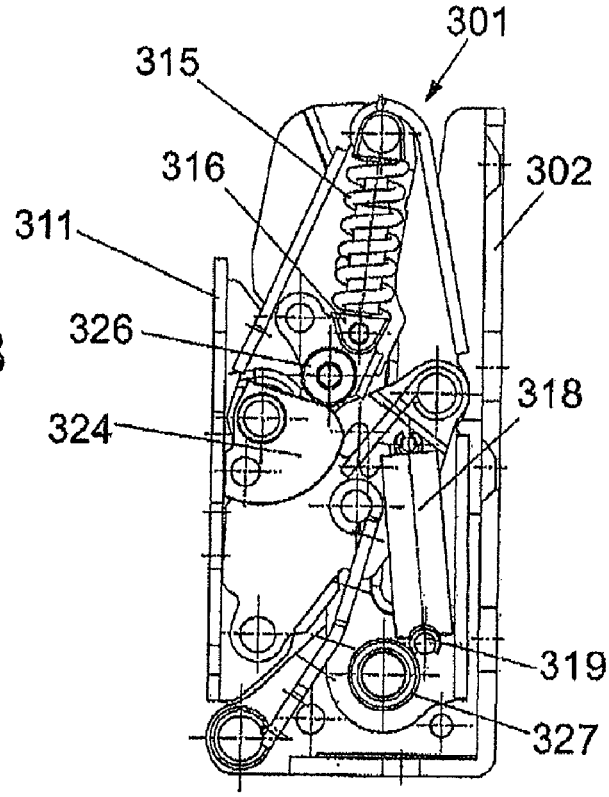

FIGS. 15A and 15B show the multi-link hinge 301 in the closed position. The spring 315 is pre-tensioned and, thus, allows a certain torque between the door bearing 311 and the fastening element 302, so that the door bearing 311 is held in the closed position. The damper 318 is retracted in this position.

In the preceding exemplary embodiments, the damper 18, 118, 218, and 318 is shown merely schematically as a linear damper with an extendable piston rod. Use may be made of different dampeners which, for example, can be moved in a smooth-running manner during extending along the piston rod, but in a sluggish manner during retracting, wherein the dampening force may differ, for example, by a factor of 5 to 20. Alternatively, it is of course possible to arrange the damper in such a way that it is sluggish during extending and smooth-running during retracting of the piston rod. Furthermore, the damper can be embodied in such a way that a dampening effect takes place only from a specific position of the piston rod relative to the housing.

What is claimed is:

1. A multi-link hinge for a door, comprising:

a fastening element securable to a furniture body;

a pivotable door bearing movable with respect to the fastening element, the pivotable door bearing defining an opened position, a closed position, and a pivot range between the opened position and the closed position;

a plurality of levers pivotably connected to one another, the plurality of levers connecting the fastening element to the pivotable door bearing;

a spring operably disposed between the fastening element and the pivotable door bearing, the spring being pretensioned to bias the pivotable door bearing into the closed position;

a linear damper operably disposed between the fastening element and the pivotable door bearing, the linear damper dampening a closing movement of the door bearing; and wherein the damper is fixed at a first end via a pin to a rotatable driver disk mounted on the fastening element, and a rotation range of the rotatable driver disk is limited by a stop resting against the fastening element.

2. The multi-link hinge as claimed in claim 1, wherein the damper is effective only over a portion of the pivot range of the pivotable door bearing.

3. The multi-link hinge as claimed in claim 2, wherein the pivot range between the opened position and the closed position is greater than 100° and the damper is effective in a closing movement of the pivot range between 20° and 40°.

4. The multi-link hinge as claimed in claim 3, wherein the closing movement of the pivot range is between 25° to 35°.

5. The multi-link hinge as claimed in claim 1, wherein the spring urges a closing movement of the pivotable door bearing in a first pivot range that is larger than a second pivot range in which the damper is effective.

6. The multi-link hinge as claimed in claim 1, wherein the plurality of levers comprises four levers and seven rotational shafts connecting the pivotable door bearing to the fastening element; and wherein the four levers include a first lever, a second lever, a third lever, and a fourth lever, the first and the second levers being rotatably mounted via two of the rotational shafts on the fastening element, and further wherein the third lever and the fourth lever are rotatably mounted via another two of the rotational shafts on the pivotable door bearing.

7. The multi-link hinge as claimed in claim 1, further comprising:

a spring bearing to which the spring is mounted at a first end of the spring;

a spring carriage to which the spring is mounted at a second end of the spring; and a roller on which the spring carriage is mounted.

8. The multi-link hinge as claimed in claim 1, further comprising a control curve by which one end of the spring moves, the control curve being coupled to the pivotable door bearing and against which control curve rests a roller, and the spring being pretensioned against the roller.

* * * * *